US010684566B1

(12) United States Patent
Luo et al.

(10) Patent No.: US 10,684,566 B1
(45) **Date of Patent: *Jun. 16, 2020**

(54) METHOD TO MAKE A PHOTOCONDUCTOR DRUM HAVING AN OVERCOAT USING A DUAL CURING PROCESS

(71) Applicant: LEXMARK INTERNATIONAL, INC., Lexington, KY (US)

(72) Inventors: Weimei Luo, Louisville, CO (US); Mark Thomas Bellino, Loveland, CO (US); Rudolph Wayne Hrobsky, Platteville, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/366,268

(22) Filed: Mar. 27, 2019

Related U.S. Application Data

(63) Continuation of application No. 16/225,362, filed on Dec. 19, 2018, which is a continuation of application No. 15/845,234, filed on Dec. 18, 2017, now Pat. No. 10,289,014.

(51) Int. Cl.

| | |
|---|---|
| ***G03G 7/00*** | (2006.01) |
| ***G03G 5/05*** | (2006.01) |
| ***G03G 5/147*** | (2006.01) |
| *B05D 3/06* | (2006.01) |
| *B05D 1/02* | (2006.01) |
| *B05D 1/18* | (2006.01) |

(52) U.S. Cl.
CPC ..... *G03G 7/0006* (2013.01); *G03G 5/0525* (2013.01); *G03G 5/147* (2013.01); *B05D 1/02* (2013.01); *B05D 1/18* (2013.01); *B05D 3/067* (2013.01); *B05D 3/068* (2013.01)

(58) Field of Classification Search
CPC ..... G03G 7/0006; G03G 5/0525
USPC ..... 430/130, 132
See application file for complete search history.

(56) References Cited

U.S. PATENT DOCUMENTS

| | | | | |
|---|---|---|---|---|
| 10,289,013 | B1 * | 5/2019 | Luo | G03G 7/0006 |
| 10,289,014 | B1 * | 5/2019 | Luo | G03G 7/0006 |
| 2015/0185641 | A1 * | 7/2015 | Bellino | G03G 5/0546 430/132 |

FOREIGN PATENT DOCUMENTS

| | | | |
|---|---|---|---|
| JP | 05150461 | A * | 6/1993 |
| JP | 07146565 | A * | 6/1995 |
| JP | 2005049736 | A * | 2/2005 |

* cited by examiner

*Primary Examiner* — Christopher D Rodee

(57) ABSTRACT

A method of preparing an organic photoconductor drum having a protective overcoat on its outermost surface is provided. In an example embodiment, a photoconductor drum having an electrically conductive substrate, a charge generation layer, a charge transport layer and an outermost protective overcoat layer is provided. The photoconductor drum is cured using a two-step process. The first curing step applies either ionizing irradiation, such as with an electron beam or by gamma rays or applies non-ionizing irradiation such as ultraviolet light to the photoconductor drum. A mask is sized and placed over the print area of the initially cured photoconductor drum, thereby exposing the outermost edges of the photoconductor drum. The outer edges of the masked photoconductor drum is then exposed to a second curing step using ultraviolet light irradiation.

1 Claim, 2 Drawing Sheets

METHOD TO MAKE A PHOTOCONDUCTOR DRUM HAVING AN OVERCOAT USING A DUAL CURING PROCESS

CROSS REFERENCES TO RELATED APPLICATIONS

This patent application is a continuation application of U.S. patent application Ser. No. 16/225,362, filed Dec. 19, 2018, entitled "Method for Curing an Overcoat in a Photoconductor Used in an Electrophotographic Imaging Device", which is a continuation application of U.S. patent application Ser. No. 15/845,234, filed Dec. 18, 2017, entitled "Method for Curing an Overcoat in a Photoconductor Used in an Electrophotographic Imaging Device".

BACKGROUND

1. Field of the Disclosure

The present disclosure relates generally to electrophotographic image forming devices, and more particularly to a method to make an organic photoconductor drum having a protective overcoat layer placed its outermost surface. A photoconductor drum having an electrically conductive substrate, a charge generation layer, a charge transport layer and a protective overcoat layer is provided. The protective overcoat is cured using a two-step process. The first curing step applies either ionizing irradiation, such as with an electron beam ('EB') or by gamma rays or applies non-ionizing irradiation such as ultraviolet ('UV') light to the overcoated photoconductor drum. A mask or shield is sized to be placed over the print area of the initially cured photoconductor drum, thereby exposing the outermost edges of the photoconductor drum. The masked photoconductor drum is then exposed to a second curing step using non-ionizing irradiation such as ultraviolet ('UV') light. This second curing step surprisingly increases the edge-wear resistance of the photoconductor drum without altering the discharge of the photoconductor drum. Increasing the edge-wear resistance of the photoconductor drum extends the life of the photoconductor drum in direct-to-paper printing applications.

2. Description of the Related Art

Organic photoconductor drums have generally replaced inorganic photoconductor drums in electrophotographic image forming device including copiers, facsimiles and laser printers due to their superior performance and numerous advantages compared to inorganic photoconductors. These advantages include improved optical properties such as having a wide range of light absorbing wavelengths, improved electrical properties such as having high sensitivity and stable chargeability, availability of materials, good manufacturability, low cost, and low toxicity.

While the above enumerated performance and advantages exhibited by an organic photoconductor drums are significant, inorganic photoconductor drums traditionally exhibit much higher durability—thereby resulting in a photoconductor having a desirable longer life. Inorganic photoconductor drums (e.g., amorphous silicon photoconductor drums) are ceramic-based, thus are extremely hard and abrasion resistant. Conversely, the surface of an organic photoconductor drums is typically comprised of a low molecular weight charge transport material, and an inert polymeric binder and are susceptible to scratches and abrasions. Therefore, the drawback of using organic photoconductor drums typically arises from mechanical abrasion of the surface layer of the photoconductor drum due to repeated use. Abrasion of photoconductor drum surface may arise from its interaction with print media (e.g. paper), paper dust, or other components of the electrophotographic image forming device such as the cleaner blade or charge roll. Of particular interest in direct-to-paper printing applications is the abrasion of the photoconductor drum surface due to the repeated interaction with the edge of the print media, typically known as paper edge wear. The abrasion of photoconductor drum surface degrades its electrical properties, such as sensitivity and charging properties. Electrical degradation results in poor image quality, such as lower optical density, and background fouling. When a photoconductor drum is locally abraded, images often have black toner bands due to the inability to hold charge in the thinner regions. This black banding on the print media often marks the end of the life of the photoconductor drum, thereby causing the owner of the printer with no choice but to purchase another expensive photoconductor drum or a new image unit, or in some cases, the whole cartridge altogether. The useful life of an organic photoconductor drums are extremely variable. Usually, organic photoconductor drums sized 30 mm in diameter can print between about 5000 to 50,000 pages before they have to be replaced.

Increasing the life of the organic photoconductor drum will allow the photoconductor drum to become a permanent part of the electrophotographic image forming device. In other words, the organic photoconductor drum will no longer be a replaceable unit nor be viewed as a consumable item that has to be purchased multiple times by the owner of the electrophotographic printer. Photoconductor drums having an 'ultra long life' allow the printer to operate with a lower cost-per-page, more stable image quality, and less waste leading to a greater customer satisfaction with his or her printing experience. An organic photoconductor drum sized 30 mm in diameter having an ultra long life can print at a minimum 150,000 pages before the consumer has to purchase a replacement.

To achieve a long life photoconductor drum, especially with organic photoconductor drum, a protective overcoat layer is coated onto the outermost surface of the photoconductor drum. A protective overcoat layer formed from a silicon material has been known to improve life of the photoconductor drums used for color printers. However, this overcoat layer does not lead to the robustness needed for edge wear in organic photoconductor drums used in direct-to-paper printing. Photoconductor overcoat formulations comprising a crosslinked layer of hexa-urethane acrylate and a crosslinkable charge transport molecule are disclosed in U.S. Pat. Nos. 8,940,466, 9,360,822, 9,417,537 and 9,417,538, which are assigned to the assignee of the present application and are incorporated by reference herein in their entirety. While the use of these urethane acrylate overcoat formulations have reduced the drum wear overall in an organic photoconductor, the improvement in paper edge wear resistance in the organic photoconductor drum in direct-to-paper printing has not been realized. This disclosure aims to further improve the paper edge wear resistance of overcoated photoconductor drums by employing a second curing step in conjunction with a mask placed over the print area of the photoconductor drum. An example of the mask is made of an aluminum sheet. The protective mask is sized to be equal the print areas of the photoconductor drum, thereby exposing the outermost edges of the photoconductor drum. The mask is placed over the overcoat after the first curing step and then the exposed edges of the overcoated photoconductor drum are subject to a second UV curing step. The purpose of the mask is to enhance the degree of polymer cross-linking in the overcoat in the paper edge area while not altering the degree of polymer cross-linking in the overcoat in the print area. Importantly the electrical discharge in the print area remains unchanged as compared to the electrical discharge in the print area of the single-step cured overcoat, however the wear resistance in the paper edge is greatly enhanced when this second curing step is performed.

SUMMARY

The present disclosure provides a method of curing a photoconductor drum used in an electrophotographic image forming device using irradiation such as with electron beam (EB) or ultraviolet (UV) light in a two-step curing process. In an example embodiment, a photoconductor drum having an electrically conductive substrate, a charge generation layer, a charge transport layer and an overcoat layer is provided. The overcoat layer is cured in a first curing step by exposing the overcoat to either ionizing irradiation, such as with an electron beam ('EB') or by gamma rays or applies non-ionizing irradiation such as ultraviolet ('UV') light to the overcoated photoconductor drum. A portion of the photoconductor where a latent image is formed during a printing operation, called the print area is then shielded with a protective mask. The photoconductor, with the print area shielded and the outermost edges or non-print areas of the photoconductor exposed, is then exposed to a second curing step using non-ionizing UV irradiation.

Also, provided is a method of curing a photoconductor drum having a protective overcoat placed over its outermost layer. The overcoat layer is cured in a first curing step by exposing the overcoat to either ionizing irradiation, such as with an electron beam ('EB') or by gamma rays or applies non-ionizing irradiation such as ultraviolet ('UV') light. The print area of the photoconductor (i.e., where the latent image is formed during a printing operation) is then shielded with a protective mask. The photoconductor, with the print area shielded and the outermost edges or non-print areas of the photoconductor exposed, is then exposed to a second curing step using UV irradiation.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
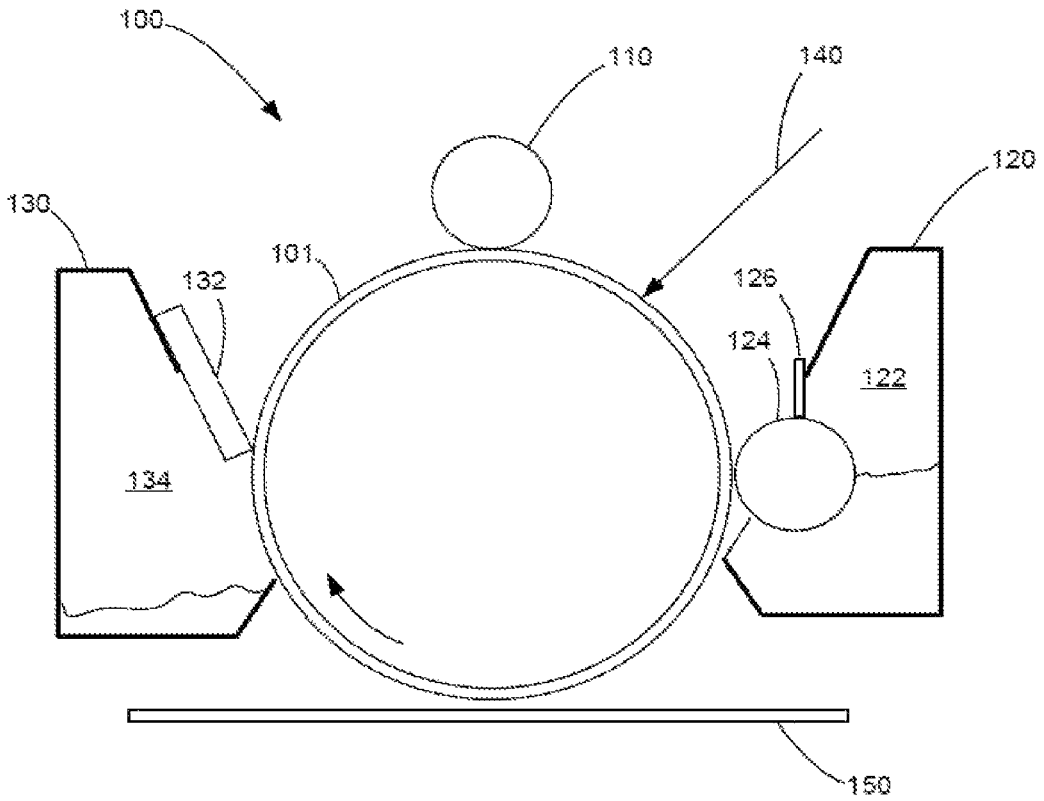
FIG. 1 is a schematic view of an electrophotographic image forming device.

It is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

FIG. 1 illustrates a schematic representation of an example electrophotographic image forming device 100. Image forming device 100 includes a photoconductor drum 101, a charge roll 110, a developer unit 120, and a cleaner unit 130. The electrophotographic printing process is well known in the art and, therefore, is described briefly herein. During a print operation, charge roll 110 charges the surface of photoconductor drum 101. The charged surface of photoconductor drum 101 is then selectively exposed to a laser light source 140 to form an electrostatic latent image on photoconductor drum 101 corresponding to the image being printed. Charged toner from developer unit 120 is picked up by the latent image on photoconductor drum 101 creating a toned image.

Developer unit 120 includes a toner sump 122 having toner particles stored therein and a developer roll 124 that supplies toner from toner sump 122 to photoconductor drum 101. Developer roll 124 is electrically charged and electrostatically attracts the toner particles from toner sump 122. A doctor blade 126 disposed along developer roll 124 provides a substantially uniform layer of toner on developer roll 124 for subsequent transfer to photoconductor drum 101. As developer roll 124 and photoconductor drum 101 rotate, toner particles are electrostatically transferred from developer roll 124 to the latent image on photoconductor drum 101 forming a toned image on the surface of photoconductor drum 101. In one embodiment, developer roll 124 and photoconductor drum 101 rotate in the same rotational direction such that their adjacent surfaces move in opposite directions to facilitate the transfer of toner from developer roll 124 to photoconductor drum 101. A toner adder roll (not shown) may also be provided to supply toner from toner sump 122 to developer roll 124. Further, one or more agitators (not shown) may be provided in toner sump 122 to distribute the toner therein and to break up any clumped toner.

The toned image is then transferred from photoconductor drum 101 to print media 150 (e.g., paper) directly by photoconductor drum 101. A fusing unit (not shown) fuses the toner to print media 150. A cleaning blade 132 (or cleaning roll) of cleaner unit 130 removes any residual toner adhering to photoconductor drum 101 after the toner is transferred to print media 150. Waste toner from cleaning blade 132 is held in a waste toner sump 134 in cleaning unit 130. The cleaned surface of photoconductor drum 101 is then ready to be charged again and exposed to laser light source 140 to continue the printing cycle.

The components of image forming device 100 are replaceable as desired. For example, in one embodiment, developer unit 120 is housed in a replaceable unit with photoconductor drum 101, cleaner unit 130 and the main toner supply of image forming device 100. In another embodiment, developer unit 120 is provided with photoconductor drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and photoconductor drum 101 and cleaner unit 130 are provided in a second replaceable unit. Further, any other combination of replaceable units may be used as desired. In some example embodiment, the photoconductor drum 101 may not be replaced and is a permanent component of the image forming device 100.

Figure 2:
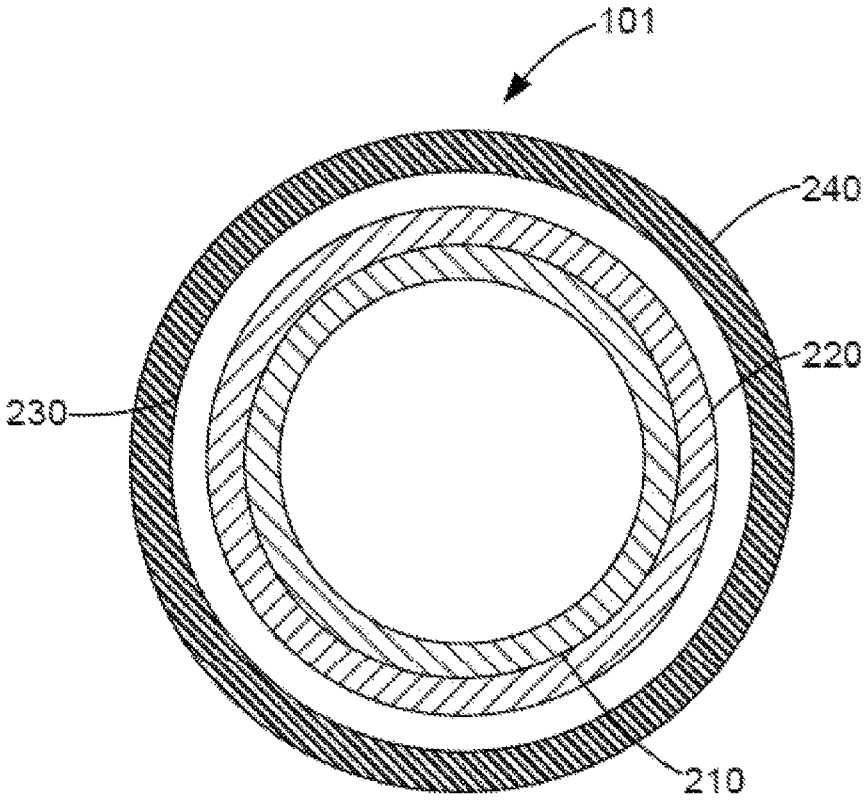
FIG. 2 is a cross-sectional view of a photoconductor drum of the electrophotographic image forming device.

FIG. 2 illustrates an example photoconductor drum 101 in more detail. In this example embodiment, the photoconductor drum 101 is an organic photoconductor drum and includes a support element 210, a charge generation layer 220 disposed over the support element 210, a charge transport layer 230 disposed over the charge generation layer 220, and a protective overcoat layer 240 formed as an outermost layer of the photoconductor drum 101. Additional layers may be included between the support element 210, the charge generation layer 220 and the charge transport layer 230, including adhesive and/or coating layers.

The support element 210 as illustrated in FIG. 2 is generally cylindrical. However the support element 210 may assume other shapes or may be formed into a belt. In one example embodiment, the support element 210 may be formed from a conductive material, such as aluminum, iron, copper, gold, silver, etc. as well as alloys thereof. The surfaces of the support element 210 may be treated, such as by anodizing and/or sealing. In some example embodiment, the support element 210 may be formed from a polymeric material and coated with a conductive coating.

The charge generation layer 220 is designed for the photogeneration of charge carriers. The charge generation layer 220 may include a binder and a charge generation compound. The charge generation compound may be understood as any compound that may generate a charge carrier in response to light. In one example embodiment, the charge generation compound may comprise a pigment being dispersed evenly in one or more types of binders.

The charge transport layer 230 is designed to transport the generated charges. The charge transport layer 230 may include a binder and a charge transport compound. The charge transport compound may be understood as any compound that may contribute to surface charge retention in the dark and to charge transport under light exposure. In one example embodiment, the charge transport compounds may include organic materials capable of accepting and transporting charges.

In an example embodiment, the charge generation layer 220 and the charge transport layer 230 are configured to combine in a single layer. In such configuration, the charge generation compound and charge transport compound are mixed in a single layer.

The overcoat layer 240 is designed to protect the photoconductor drum 101 from wear and abrasion without altering the electrophotographic properties, thus extending the service life of the photoconductor drum 101. The overcoat layer 240 has a thickness of about 0.1 μm to about 10 μm. Specifically, the overcoat layer 240 has a thickness of about 1 μm to about 6 μm, and more specifically a thickness of about 3 μm to about 5 μm. The thickness of the overcoat layer 240 is kept at a range that will not provide adverse effect to the electrophotographic properties of the photoconductor drum 101. The overcoat layer 240 includes a three-dimensional crosslinked structure formed from a curable composition. The curable composition may include a urethane resin having at least six radical polymerizable functional groups, and a charge transport molecule having at least one radical polymerizable functional group.

The present invention describes a method of curing the photoconductor overcoat layer including an additional cure outside a print area. The print area is the section of the photoconductor where a toner image is formed, and that comes into contact with the print media during a printing operation. A photoconductor drum is formed using an aluminum substrate, a charge generation layer coated onto the aluminum substrate, and a charge transport layer coated on top of the charge generation layer. An overcoat formulation is then dipcoated onto the photoconductor drum, and air-dried to form a tacky coating. The photoconductor drum is then cured using an EB in a first curing step. A shield is then placed over the print area of the photoconductor drum, before exposing the photoconductor drum to UV to enhance the cure in the ends of the photoconductor drum in a second curing step. This dual cure outside the print area improves the resistance of the thus-formed overcoat layer to paper edge wear without adversely affecting the electrical properties of the photoconductor in the print area. The diagram below illustrates the second cure with a shield to protect the print area.

The overcoat layer 240 is designed to protect the photoconductor drum 101 from wear and abrasion without altering the electrophotographic properties, thus extending the service life of the photoconductor drum 101. The overcoat layer 240 has a thickness of about 0.1 μm to about 10 μm. Specifically, the overcoat layer 240 has a thickness of about 1 μm to about 6 μm, and more specifically a thickness of about 1-4 μm. The thickness of the overcoat layer 240 is kept at a range that will not provide adverse effect to the electrophotographic properties of the photoconductor drum 101.

In an example embodiment, the overcoat layer 240 includes a three-dimensional crosslinked structure formed from a curable composition. The curable composition consists of a urethane resin having at least six radical polymerizable functional groups and a multifunctional charge transport material. The curable composition includes about 50 percent to about 80 percent by weight of the urethane resin having at least six crosslinkable functional groups, and about 20 percent to about 50 percent by weight of crosslinkable charge transport material (CTM). In an example embodiment, the curable composition includes 50 percent by weight of the urethane resin having at least six radical polymerizable functional groups, and 50 percent by weight of the crosslinkable CTM.

The at least six radical polymerizable functional groups of the urethane resin may be the same or different and may be selected from the group consisting of acrylate, methacrylate, styrenic, allylic, vinylic, glycidyl ether, epoxy, or combinations thereof. A particularly useful urethane resin having at least six radical polymerizable functional groups includes a hexa-functional aromatic urethane acrylate resin, a hexa-functional aliphatic urethane acrylate resin, or combinations thereof.

In an example embodiment, the hexa-functional aromatic urethane acrylate resin has the following structure:

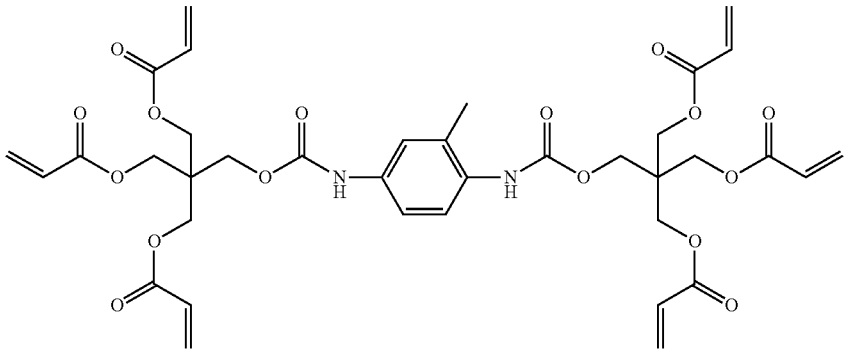

and is commercially available under the trade name CN975 manufactured by Sartomer Corporation, Exton, Pa.

In an example embodiment, the hexa-functional aliphatic urethane acrylate resin has the following structure:

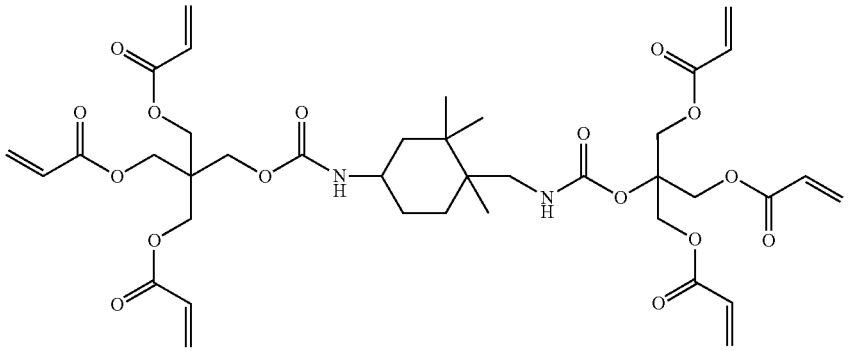

and is commercially available under the trade name EBECRYL® 8301 manufactured by Cytec Industries, Woodland Park, N.J.

The curable composition may further include a monomer or oligomer having at most five radical polymerizable functional groups. The at most five radical polymerizable functional groups of the monomer or oligomer may be selected from the group consisting of acrylate, methacrylate, styrenic, allylic, vinylic, glycidyl ether, epoxy, or combinations thereof.

Suitable examples of mono-functional monomers or oligomers include, but are not limited to, methyl acrylate, methyl methacrylate, ethyl acrylate, ethyl methacrylate, propyl acrylate, propyl methacrylate, isobornyl acrylate, isobornyl methacrylate, 2-phenoxyethyl acrylate, and lauryl methacrylate.

Suitable examples of di-functional monomers or oligomers includes, but are not limited to, diacrylates and dimethacrylates, comprising 1,4-butanediol diacrylate, 1,4-butanediol dimethacrylate, ethylene glycol dimethacrylate, diethylene glycol diacrylate, diethylene glycol dimethacrylate, triethylene glycol diacrylate, triethylene glycol dimethacrylate, 1,3-butylene glycol diacrylate, 1,6-hexanediol diacrylate, 1,6-hexanediol dimethacrylate, 1,12-dodecanediol methacrylate, tripropylene glycol diacrylate, 1,3-butylene glycol dimethacrylate, 1,3-butylene glycol dimethacrylate, cyclohexane dimethanol diacrylate esters, or cyclohexane dimethanol dimethacrylate esters.

Suitable examples of tri-functional monomers or oligomers include, but are not limited to, trimethylolpropane triacrylate, trimethylolpropane trimethacrylate, hydroxypropyl acrylate-modified trimethylolpropane triacrylate, ethylene oxide-modified trimethylolpropane triacrylate, propylene oxide-modified trimethylolpropane triacrylate, and caprolactone-modified trimethylolpropane triacrylate.

Suitable examples tetrafunctional monomers or oligomers include, but are not limited to, pentaerythritol tetraacrylate, ethoxylated pentaerythritol tetraacrylate, and di(trimethylolpropane) tetraacrylate.

Suitable examples pentafunctional monomer or oligomer include, but are not limited to, pentaacrylate esters, dipentaerythritol pentaacrylate esters, and melamine pentaacrylates.

The composition may further include an additive such as a surfactant at an amount equal to or less than about 10 percent by weight of the curable composition. More specifically, the amount of additive is about 0.1 to about 5 percent by weight of the curable composition. The additive may improve coating uniformity of the curable composition or modify the coating surface. The additive can be crosslinkable or non-crosslinkable.

The solvent may include organic solvent. The curable composition may be coated on the outermost surface of the photoconductor drum 101 through dipping or spraying. If the curable composition is applied through dip coating, an alcohol is used as the solvent to minimize dissolution of the components of the charge transport layer 230. The alcohol solvent includes isopropanol, methanol, ethanol, butanol, or combinations thereof. In an example embodiment, the solvent is ethanol.

The curable composition is prepared by mixing the urethane resin and charge transport molecules in a solvent. The organic solvent can be selected from alcohols, tetrahydrofuran (THF), toluene, butanone, cyclohexanone. In one example embodiment, the solvent may include a mixture of two or more organic solvents to solubilize the urethane resin and radical polymerizable charge transport molecule while minimizing solubility of components within the underlying photoconductor structure. The curable composition may be coated on the outermost surface of the photoconductor drum 101 through dipping or spraying. If the curable composition is applied through dip coating, an alcohol is used as the solvent to minimize dissolution of the components of the charge transport layer 230. The alcohol solvent includes isopropanol, methanol, ethanol, butanol, or combinations thereof.

The coated curable composition on the outermost surface of the photoconductor drum is exposed to irradiation of an electron beam or UV light of sufficient energy to induce formation of free radicals to initiate the crosslinking. In an embodiment, the coated curable composition on the outermost surface of the photoconductor drum is cured using an electron beam (EB) dose of between about 10 kiloGrays (kGy) and about 100 kGy, particularly between about 20 kGy and 40 kGy. The photoconductor drum cured using this above-described first EB curing step is then masked in the print area and subjected to a second curing step using UV irradiation exposure of between about 0.1 to about 2 J/cm$^2$. The dual cured photoconductor drum is placed in oven for thermal cure to remove solvent, anneal and relieve stresses in the coating.

Preparation of Photoconductor Drum

Photoconductor drums were formed using an aluminum substrate, a charge generation layer coated onto the aluminum substrate, and a charge transport layer coated on top of the charge generation layer.

The charge generation layer was prepared from a dispersion including type IV titanyl phthalocyanine, polyvinylbutyral, poly(methyl-phenyl)siloxane and polyhydroxystyrene at a weight ratio of 45:27.5:24.75:2.75 in a mixture of 2-butanone and cyclohexanone solvents. The polyvinylbutyral is available under the trade name BX-1 by Sekisui Chemical Co., Ltd. The charge generation dispersion was coated onto the aluminum substrate through dip coating and dried at 100° C. for 15 minutes to form the charge generation layer having a thickness of less than 1 μm, specifically a thickness of about 0.2 μm to about 0.3 μm.

The charge transport layer was prepared from a formulation including terphenyl diamine derivatives (450 g) and polycarbonate Z300 (550 g) in a mixed solvent of THF and 1,4-dioxane. The charge transport formulation was coated on top of the charge generation layer and cured at 120° C. for 1 hour to form the charge transport layer having a thickness of about 25 μm to about 27 μm as measured by an eddy current tester.

Preparation of Photoconductor 1 Using Dual Curing Process

The above-described photoconductor drum is overcoated with an overcoat layer prepared from a formulation including a difunctional tri-arylamine (25 g), EBECRYL 8301 (25 g), ethanol (100 g), and Dow Corning DC401LS additive (0.02 g). The formulation was dip coated on the outer surface of a photoconductor drum described above. The coated layer was then exposed to an electron beam source at an accelerating voltage of 90 kV, a current of 9 mA for an exposure time of 0.6 seconds. The drum was then covered with an aluminum foil mask over the print area (covering a longitudinal length of about 22 mm to 235 mm from one end of the photoconductor drum) and exposed to UV using a Fusion UV H bulb for 1 second. The photoconductor with the cured overcoat layer was then thermally cured at 120° C. for 60 minutes. The thickness of the overcoat was 3 μm as determined by eddy curry measurement.

Preparation of Comparative Photoconductor 1 Using Single Curing Process

The above-described photoconductor drum is overcoated with an overcoat layer prepared from a formulation including a difunctional tri-arylamine (25 g), EBECRYL 8301 (25 g), ethanol (100 g), and Dow Corning DC401LS additive (0.02 g). The formulation was dip coated on the outer surface of a photoconductor drum described above. The coated layer was then exposed to an electron beam source at an accelerating voltage of 90 kV, a current of 9 mA for an exposure time of 0.6 seconds. The photoconductor was then thermally cured at 120° C. for 60 minutes.

Preparation of Comparative Photoconductor 2 Using Single Curing Process

The above-described photoconductor drum is overcoated with an overcoat layer prepared from a formulation including a difunctional tri-arylamine (25 g), EBECRYL 8301 (25 g), ethanol (100 g), and Dow Corning DC401LS additive (0.02 g). The formulation was dip coated on the outer surface of a photoconductor drum described above. The coated layer was then exposed to an electron beam source at an accelerating voltage of 90 kV, a current of 9 mA for an exposure time of 1.2 seconds. The photoconductor was then thermally cured at 120° C. for 60 minutes. The cured cross-linked layer forms the overcoat layer having a thickness of about 1.5 μm. as measured by an eddy current tester. The overcoat thickness may be adjusted by either varying the amount of solvent or changing the coat speed.

The photoconductor drums prepared in Example 1, and Comparative Examples 1 and 2 were installed in the electrophotographic image forming device. The electrophotographic image forming device was then operated at 70 ppm in a four-page and pause run mode. Wear rates, image print quality and discharge voltage for each of the installed photoconductor drums were then monitored. Results are presented in Table 1.

TABLE 1

| Photoconductor Drum | Discharge Voltage | Ave. Wear rate at paper edge, (μm/M rev) | Max. Wear at paper edge, μm of coating loss after 200k pages |
|---|---|---|---|
| 1 (EB + UV) | −80 | 0.96 | 1.5 |
| Comparative 1 (EB) | −48 | 1.63 | — |
| Comparative 2 (EB, 100% increase in exposure time) | −73 | — | >4 |

As previously mentioned, paper edge wear is the dominant factor in determining photoconductor drum life in direct-to-paper printing applications. Typically, the highest loss in overcoat thickness tends to occur at about 237 mm from one end of the photoconductor drum. Overcoat thickness loss was taken at 200,000 pages printed for Photoconductor Drum 1 and Comparative Photoconductor Drum 2. As shown in Table 1, the maximum wear point, or overcoat thickness loss, in Photoconductor Drum 1 is 1.5 μm, while the maximum wear point for Comparative Photoconductor Drum 2 is more than 4 μm. This shows that the use of additional UV curing outside of the print area dramatically increases the resistance of a photoconductor to paper edge wear, even when compared to a photoconductor cured with a 100% increased EB dose.

As illustrated in Table 1, Photoconductor Drum 1 dual cured using both EB and UV has a discharge voltage comparable to the discharge voltage of Comparable Photoconductor Drum 2 having a 100% increase in EB exposure. Photoconductor Drum 1 has a residual charge of about 32V higher than Comparative Photoconductor 1 cured using the same dose of EB but not exposed to the second UV curing step. Photoconductor Drum 1 prepared using the dual curing steps exhibits higher resistance to paper edge wear (0.96 μm/M rev) while importantly maintaining similar electrical discharge readings comparable to Comparative Photoconductor Drum 1.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A method of preparing an overcoated photoconductor drum comprising:

providing an electrically conductive substrate;

preparing a charge generation layer dispersion;

coating the charge generation layer dispersion onto the electrically conductive substrate and drying the charge generation layer dispersion coated on the electrically conductive substrate to form a charge generation layer;

preparing a charge transport layer solution;

coating the charge transport layer solution over the charge generation layer and curing the charge transport layer solution coated on the charge generation layer to form a charge transport layer;

preparing an overcoat layer formulation;

dip coating the overcoat layer formulation over the charge transport layer;

curing, in a first curing step, the overcoat layer formulation using a dose of ultraviolet non-ionizing irradiation to form an overcoated cured photoconductor drum;

shielding with an aluminum mask sized to cover a print area of the overcoated cured photoconductor drum and thereby expose an outer edge of the overcoated cured photoconductor drum located outside the print area;

curing, in a second curing step, the outer edge of overcoated cured photoconductor drum located outside the print area using ultraviolet non-ionizing irradiation exposure between about 0.1 $J/cm^2$ and about 2 $J/cm^2$ to produce an overcoated dual cured photoconductor drum; and thermally curing the overcoated dual cured photoconductor drum in an oven at 120° C. for 60 minutes.

* * * * *